US012365424B2

(12) United States Patent
Chen et al.

(10) Patent No.: US 12,365,424 B2
(45) Date of Patent: Jul. 22, 2025

(54) SUBMARINE STRATUM SPACE CABLE LAYING ROBOT

(71) Applicant: ZHEJIANG UNIVERSITY, Hangzhou (CN)

(72) Inventors: Jiawang Chen, Hangzhou (CN); Peihao Zhang, Hangzhou (CN); Xingshuang Lin, Hangzhou (CN); Hai Zhu, Hangzhou (CN); Yongqiang Ge, Hangzhou (CN); Zhenwei Tian, Hangzhou (CN); Tao Liang, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 525 days.

(21) Appl. No.: 17/956,295

(22) Filed: Sep. 29, 2022

(65) Prior Publication Data

US 2023/0135602 A1 May 4, 2023

(30) Foreign Application Priority Data

Nov. 2, 2021 (CN) ..... 202111286281.8

(51) Int. Cl.
*B63B 35/04* (2006.01)
*B63G 8/00* (2006.01)

(52) U.S. Cl.
CPC ..... *B63B 35/04* (2013.01); *B63G 8/001* (2013.01); *B63G 2008/004* (2013.01)

(58) Field of Classification Search
CPC .. B63B 35/04; B63G 8/001; B63G 2008/004; E21B 7/124; F16L 1/12
See application file for complete search history.

(56) References Cited

U.S. PATENT DOCUMENTS 4,010,619 A * 3/1977 Hightower ..... D07B 1/147 174/113 C
4,537,530 A * 8/1985 Yamamura ..... E02F 9/2045 405/160
4,749,308 A * 6/1988 Izawa ..... E02F 3/8858 405/161
5,722,793 A * 3/1998 Peterson ..... B63B 35/06 405/164

(Continued)

FOREIGN PATENT DOCUMENTS

CN 110847823 A * 2/2020 ..... E21B 10/43

*Primary Examiner* — Benjamin F Fiorello
(74) *Attorney, Agent, or Firm* — Howard IP Law Group

(57) ABSTRACT

A main body structure of a submarine stratum space cable laying robot includes one telescopic electric linear actuator unit including two dustproof sleeves with one sleeved on the other, and four single supporting arm units for forward motion and supporting. Two ends of each single supporting arm unit are sequentially provided with rotating supporting plates, reducers, motors and connecting flanges from inside to outside, and an outside of each single supporting arm unit is provided with a rotating plate structure. The single supporting arm units in each group are movably connected by the adjacent ends and movably connected to connectors of the telescopic electric linear actuator unit by respective outer ends thereof. The two groups of single supporting arm units connected in series are symmetrically arranged, such that a whole main body structure of the robot is diamond-shaped.

10 Claims, 6 Drawing Sheets

(56) References Cited

U.S. PATENT DOCUMENTS

| | | | | |
|---|---|---|---|---|
| 7,055,625 | B1 * | 6/2006 | Myrick | E21B 49/06 175/58 |
| 7,520,696 | B2 * | 4/2009 | Pihl | E02F 5/105 405/161 |
| 9,140,383 | B2 * | 9/2015 | Oldervoll | H02G 1/10 |
| 10,954,652 | B2 * | 3/2021 | Berque | F03D 13/10 |
| 2019/0022875 | A1 * | 1/2019 | Galloway | B25J 15/0475 |
| 2021/0148503 | A1 * | 5/2021 | Fekrmandi | F16L 55/34 |

* cited by examiner

SUBMARINE STRATUM SPACE CABLE LAYING ROBOT

CROSS REFERENCE TO RELATED APPLICATION

This patent application claims the benefit and priority of Chinese Patent Application No. 202111286281.8 filed on Nov. 2, 2021, the disclosure of which is incorporated by reference herein in its entirety as part of the present application.

TECHNICAL FIELD

The present disclosure relates to the robotics, and particularly relates to a robot capable of performing peristaltic forward motion in the soil of the submarine sediment stratum and used for laying cables in a submarine stratum space.

BACKGROUND

The vast seabed is rich in strategic resources. In order to fulfil the task of submarine stratum space exploration and operation, the required cables or sensor cables should first be placed into the submarine stratum space to realize the operation of the submarine stratum space or the monitoring of the submarine stratum environment.

At present, the most common means of laying cables for the field of submarine stratum space is to use a drilling ship. Although the drilling ship is good in drilling depth and operation controllability and may rapidly fulfil the task, its limitations are also obvious. That is, the drilling ship can only operate at a single point in each operation, and thus cannot move flexibly, and the drilling ship continuously disturbs the stratum in the drilling depth process, and thus is more destructive. In addition, each drilling requires the drilling ship to operate continuously in situ, which is more applicable to large-scale exploitation operations than small-scale cable laying operations.

Therefore, the present disclosure is intended to provide a small robot which can be used for submarine stratum space cable laying. The robot body is used as a traction and laying mechanism, and the tail of the robot drags the cable to move in the stratum, and the cable laying operation is completed after the cable reaches the specified position by means of the established motion trajectory planning scheme. The robot will fill the gap of technical equipment in the field of submarine stratum space cable laying, and has a wide range of application scenarios and is of an important significance.

SUMMARY

The technical problem to be solved by the present disclosure is to overcome the shortcomings in the prior art and provide a submarine stratum space cable laying robot.

To solve the technical problem, the solution provided by the present disclosure is as follows.

The present disclosure provides a submarine stratum space cable laying robot, including a main body structure of the robot serving as a traction tool. A tail end of the main body structure is provided with a connecting terminal for connecting an energy supply cable, and a latched mechanism for hanging a cable to be laid. The main body structure of the robot includes:

one telescopic electric linear actuator unit, including two dustproof sleeves with one sleeved on another to form a closed internal cavity together; a driving motor and telescopic electric linear actuators are arranged in the closed internal cavity to enable the two dustproof sleeves to displace relative to each other along an axial direction; and connectors are respectively arranged at two closed ends of the dustproof sleeves; and four single supporting arm units having a same structure and being for forward motion and supporting, each includes a hollow single supporting arm cylinder; two ends of each single supporting arm unit are symmetrically and sequentially provided with rotating supporting plates, reducers, motors and connecting flanges from inside to outside respectively; an outside of the hollow single supporting arm cylinder is provided with a rotating plate structure, and the rotating plate structure is provided with rotating plate components symmetrically arranged along the axial direction.

The four single supporting arm units are divided into two groups, two single supporting arm units in each group are movably connected by connecting flanges at adjacent ends of the two single supporting arm units and are movably connected to the connectors of the telescopic electric linear actuator unit by connecting flanges on respective outer ends of the two single supporting arm units; the two groups of single supporting arm units connected in series are symmetrically arranged with the telescopic electric linear actuator unit as an axis, such that the main body structure of the robot is diamond-shaped.

In some embodiments, the rotating plate component is comb-shaped and sieve-shaped, and is fitted with a baffle. In some embodiments, the baffle is a toothed baffle or a sieve baffle that can be driven by a driving component to displace so as to shield gaps between teeth or shield sieve pores.

In some embodiments, the driving component is an electric linear actuator arranged in a cavity of the hollow single supporting arm cylinder, the baffle is connected to the electric linear actuator and displaced in an axial direction under driving of the electric linear actuator to shield the gaps between the teeth or the sieve pores of the rotating plate component; the baffle has a structure and a shape adaptive to the rotating plate component and covers the rotating plate component precisely; or an axial groove is formed in a middle of the rotating plate component, and the baffle is arranged in the axial groove.

In some embodiments, in a direction perpendicular to a symmetry axis, cross-sectional shapes of the rotating plate structure and the baffle are diamond-shaped.

In some embodiments, the rotating plate structure includes two rotating plate components which are symmetrically arranged in an axial direction, a center of each rotating plate component is provided with a semi-circular groove for installing the single supporting arm cylinder; two ends of each of the rotating plate component and the single supporting arm cylinder are fixed to the rotating supporting plates respectively; or an axial center of the rotating plate structure is provided with a tubular cavity, the single supporting arm cylinder is sleeved in the rotating plate structure, and two ends of the rotating plate structure or the single supporting arm cylinder are fixed to the rotating supporting plates; or the rotating plate structure and the single supporting arm cylinder are of an integrated structure, two ends of which are fixed to the rotating supporting components.

In some embodiments, the rotating supporting plates are fixedly connected to the reducers, the reducers are connected to output ends of the motors, and the motors are fixedly connected to the connecting flanges.

In some embodiments, two ends of each of the telescopic electric linear actuators are connected to outer ends of the dustproof sleeves respectively.

In some embodiments, the two dustproof sleeves are in clearance fit and sealed with an O-shaped sealing ring.

In some embodiments, two connectors are arranged at each of outer ends of the dustproof sleeves, and the connecting flanges at outer ends of each group of single supporting arm units are respectively connected to corresponding connectors.

In some embodiments, the connectors and the connecting flanges are provided with through holes, the connectors and the connecting flanges, as well as the connecting flanges and the connecting flanges are connected by passing pins into the through holes.

Compared with the prior art, the present disclosure has the following beneficial effects.

(1) The present disclosure employs a modular design structure, various body units are independent of one another, and thus have flexible motion ability.

(2) An innovative peristaltic robot motion mode is proposed by the present disclosure through the combined action of the four single supporting arm units. Each single supporting arm unit performs the function of forward motion or supporting respectively, and under the combined action of these body units, the robot may fulfill and achieve the tasks of forward motion and turning. When two single supporting arm units are used for supporting and the other two single supporting arm units are used for forward motion, the forward motion of the submarine stratum space cable laying robot may be realized. When one single supporting arm unit is used for supporting and three single supporting arm units are used for forward motion, the turning of the submarine stratum space cable laying robot may be realized.

(3) By use of the innovative peristaltic forward motion mode, under the driving of two groups of rotating mechanisms including harmonic reducers and motors, supporting the rotation switching state of the single supporting arm unit not only improves the efficiency of forward motion, but also reduces the resistance encountered in the process of forward motion.

(4) By use of an innovative structure design mode, the two single supporting arm units at the front part and the two single supporting arm units at the rear part each employ a V-shaped structure design. In the process of forward motion, an included angle between the two single supporting arm units is continuously reduced along with the extension of the telescopic linear actuator, thereby greatly reducing the resistance in the motion process.

(5) The submarine stratum space cable laying robot has good portability and expansibility, has a wide range of application scenarios in moving forwards in the submarine stratum and laying submarine stratum sensors, and has a wide range of applications in marine technology, marine engineering, marine science and other research fields.

Figure 1:
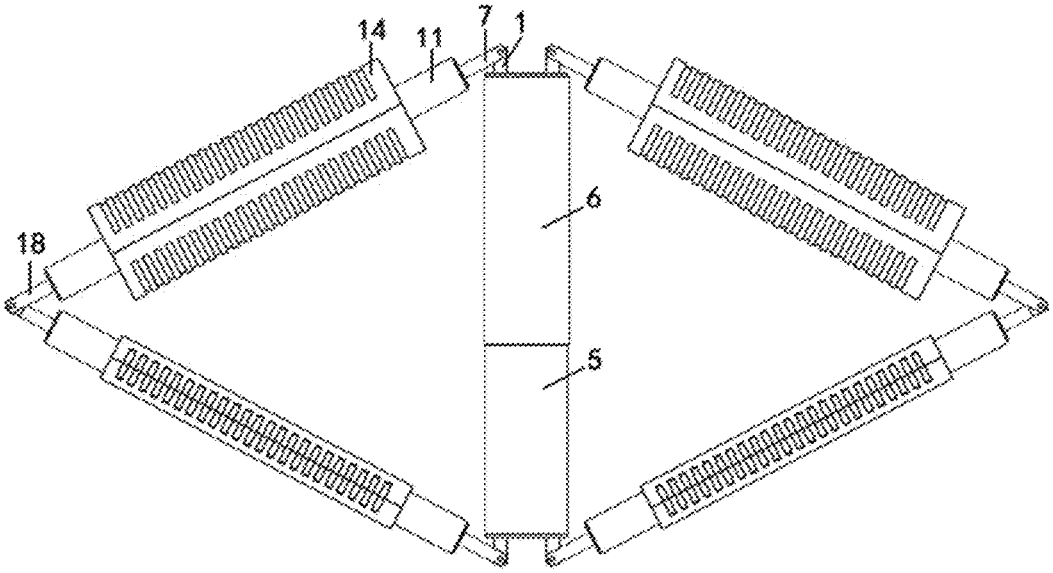
FIG. 1 is a schematic diagram of an overall structure in accordance with the present disclosure.
Figure 2:
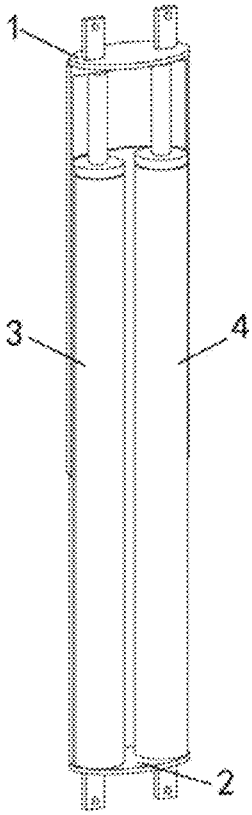
FIG. 2 is an enlarged partial sectional view of a telescopic forward motion body unit of a robot main body.

Reference numerals: 1—front connector; 2—rear connector; 3—left telescopic electric linear actuator; 4—right telescopic electric linear actuator; 5—lower dustproof sleeve; 6—upper dustproof sleeve; 7—upper connecting flange; 8—upper motor; 9—upper harmonic reducer; 10—upper rotating plate supporting component; 11—single supporting arm cylinder; 12—electric linear actuator; 13—rotating plate component; 14—toothed baffle; 15—lower rotating plate supporting component; 16—lower harmonic reducer; 17—lower motor; 18—lower connecting flange.

DETAILED DESCRIPTION

The following embodiments will make those skilled in the art have a more comprehensive understanding of the present disclosure, but do not limit the present disclosure in any way.

The serial numbers themselves, such as "first", "second", etc., given to the parts in the present disclosure are used only to distinguish the objects described and do not have any sequential or technical meaning. While the "connection" and "coupling" in this application, unless otherwise specified, include direct and indirect connection (coupling). In the description of the present disclosure, it should be noted that orientation or positional relationship indicated by the terms "upper", "lower", "front", "back", "left", "right", "vertical", "horizontal", "top", "bottom", "inside", "outside", "clockwise", "counterclockwise" and the like is based on the orientation or positional relationship shown in the drawings only for the convenience of description of the present invention and simplification of description rather than indicating or implying that the device or element referred to must have a particular orientation, be constructed and operated in a particular orientation, and thus are not to be construed as limiting the present disclosure.

In accordance with the present disclosure, unless otherwise expressly specified and limited, the first feature "on" or "under" the second feature may be that the first feature is in direct contact with the second feature, or the first feature is in indirect contact with the second feature through an intermediate medium. Moreover, the first feature is "above", "over" and "on" the second feature may be that the first feature is directly above or diagonally above the second feature, or simply represents that a horizontal height of the first feature is higher than the second feature. The first feature is "under", "below" and "beneath" the second feature may be that the first feature is right below the second feature and diagonally below the second feature, or merely represents that a horizontal height of the first feature is lower than the second feature.

As shown in FIG. 1, a submarine stratum space cable laying robot includes a main body structure serving as a traction tool. The main body structure of the robot includes one telescopic electric linear actuator unit, and four single supporting arm units for supporting and forward motion, having the same structure (hereinafter referred to as single supporting arm unit). A tail end of the telescopic electric linear actuator unit is provided with a connecting terminal for connecting an energy supply control cable and a latched mechanism (not shown in the figure) for hanging cables to be laid.

The telescopic electric linear actuator unit includes a lower dustproof sleeve 5 and an upper dustproof sleeve 6 with one sleeved on the other to form a closed internal cavity together. The two dustproof sleeves are in clearance fit and are sealed with an O-shaped sealing ring to protect an electric linear actuator mechanism from mud or soil particles. A driving motor, a left telescopic electric linear actuator 3 and a right telescopic electric linear actuator 4 are arranged in the closed internal cavity, the left telescopic electric linear actuator 3 and the right telescopic electric linear actuator 4 are symmetrically distributed along a central axis to form a dual electric-push-rod mechanism. Two ends of each of the telescopic electric linear actuators are connected to the ends of the dustproof sleeves to enable the lower dustproof sleeve 5 and the upper dustproof sleeve 6 to displace relative to each other in an axial direction. Two connectors are respectively arranged at two closed ends of the dustproof sleeves, and are provided with through holes for insertion of pins.

The four single supporting arm units are respectively arranged at a left front part, a right front part, a left rear part and a right rear part of the robot, and have the completely same structure. The single supporting arm unit at the left front part is provided as an example. The single supporting arm unit includes a hollow single supporting arm cylinder 11, two ends of which are symmetrically provided with the following structures: an upper rotating plate supporting component 10, an upper harmonic reducer 9, an upper motor 8 and an upper connecting flange 7 sequentially provided on one end from inside to outside; a lower rotating plate supporting piece 15, a lower harmonic reducer 16, a lower motor 17, and a lower connecting flange 18 sequentially provided on the other end from inside to outside, and each connecting flange is provided with a through hole for insertion of the pin.

The four single supporting arm units are divided into two groups, and the single supporting arm units in each group are movably connected in series by the connecting flanges at the adjacent ends thereof, and are movably connected to the connectors on the telescopic electric linear actuator unit by the connecting flanges at the respective outer ends. The connector and the connecting flange, as well as the connecting flange and the connecting flange are connected to each other by passing the pins into the through holes. Two groups of single supporting arm units connected in series are symmetrically arranged with the telescopic electric linear actuator unit as the axis, such that the main body structure of the robot is diamond-shaped.

The outside of the single supporting arm cylinder is provided with a rotating plate structure. In a direction perpendicular to the symmetric axis, the rotating plate structure has a roughly diamond-shaped cross section and is provided with rotating plate components 13 symmetrically arranged along the axis. The rotating plate components are comb-shaped, and are fitted with a toothed baffle 14 with an adaptive structure and shape. The toothed baffle 14 covers the outside of the rotating plate components and may displace under driving of a driving component, to shield the gaps between the teeth. Or, a groove may be formed in the middle of the rotating plate components in an axial direction, and the baffle is arranged in the groove. The driving component may be an electric linear actuator 12 arranged in the cavity of the single supporting arm 11, the toothed baffle 14 is connected to the electric linear actuator 12 and may displace in the axial direction under the driving of the electric linear actuator 12 so as to shield the gaps between the teeth of the rotating plate components 13. The rotating plate components may also be sieve-shaped, the sieve baffle capable of displacing is used for shielding the sieve pores under the driving of the driving component.

Figure 3:
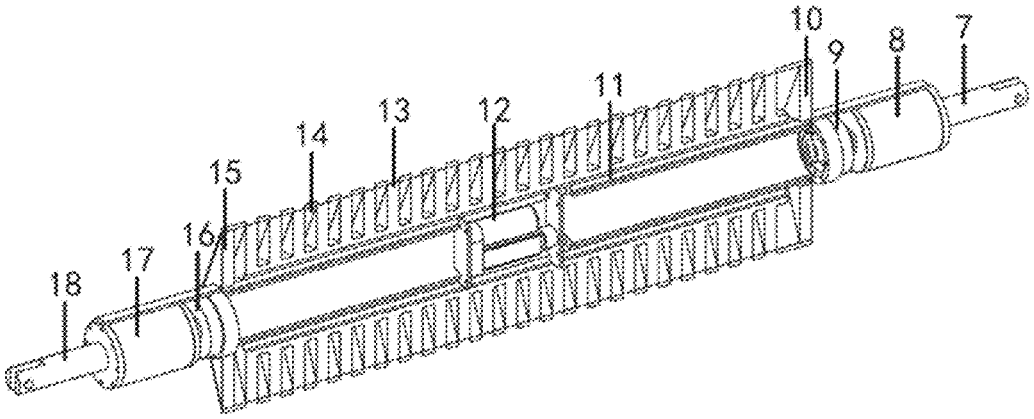
FIG. 3 is an enlarged sectional view of a single supporting arm unit.
Figure 4:
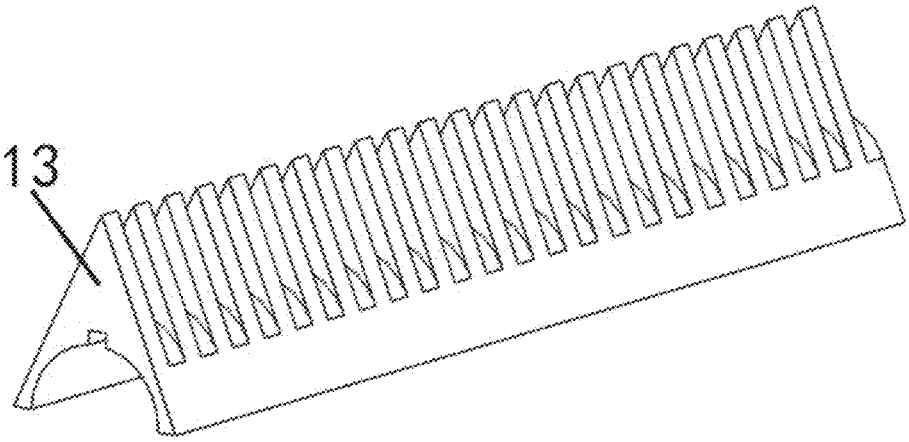
FIG. 4 is a schematic diagram of a rotating plate component in a rotating plate structure.
Figure 5:
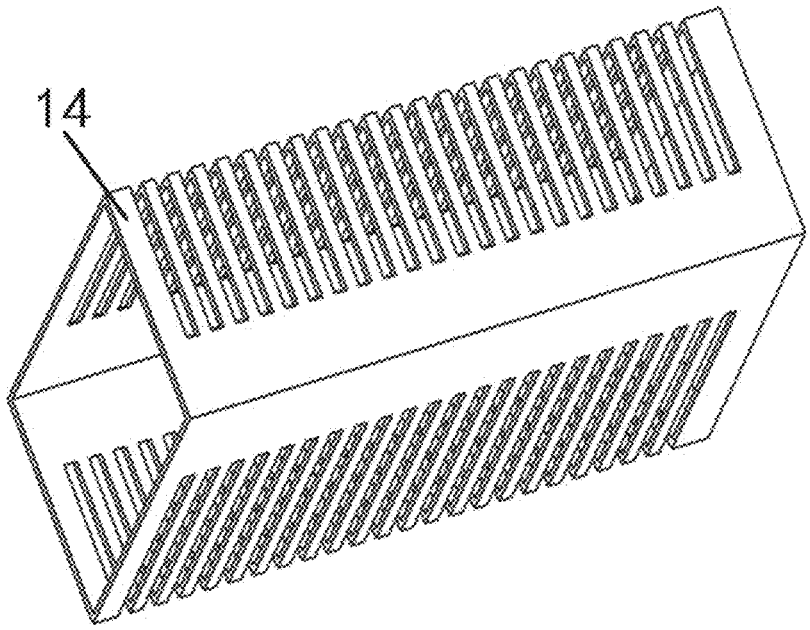
FIG. 5 is a schematic diagram of a toothed baffle for the rotating plate structure in FIG. 4.

The rotating plate structure may be implemented in various ways. As shown in FIGS. 3 and 4, the rotating plate structure includes two rotating plate components which are symmetrically arranged in an axial direction, the center of each rotating plate component is provided with a semicircular groove for installing the single supporting arm cylinder 11, and the two rotating plate components are oppositely arranged at the outside of the single supporting arm cylinder 11; two ends of each of the rotating plate component and the single supporting arm cylinder 11 are fixed to the rotating supporting plates. Or, the axial center of the rotating plate structure is provided with a tubular cavity, the single supporting arm cylinder 11 is nested in the rotating plate structure, and two ends of the rotating plate structure or the single supporting arm cylinder 11 are fixed to the rotating supporting plates. Or, the rotating plate structure and the single supporting arm structure are of an integrated structure, two ends of which are fixed to the rotating supporting plates. Each rotating plate supporting component is fixedly connected to the reducer, the reducer is connected to the output end of the motor, and the motor is fixedly connected to the connecting flange.

In accordance with the present disclosure, the main body structure of the submarine space cable laying robot includes four single supporting arm units for supporting and forward motion, and one telescopic electric linear actuator unit. By taking the telescopic electric linear actuator unit as the center of the symmetry axis, the four single supporting arm units are arranged in a four-sided diamond shape, and movable connection is realized at the opposite corners of the four-sided diamond shape. The cable laying robot moves with the coordination of both the single supporting arm units and the telescopic electric linear actuator unit. When the telescopic electric linear actuator is extended to the longest, the robot is in a fully expanded state, and when the telescopic electric linear actuator is shortened to the shortest, the robot is in a fully contracted state. The four single supporting arm units are controlled to be in different spatial states to take the functions of forward motion and supporting. Under the combined action of the single supporting arm units and the telescopic electric linear actuator unit, the forward motion and turning of the robot are achieved.

The telescopic electric linear actuator may provide a thrust force when the robot moves forwards or steers. The dustproof sleeve may protect the telescopic electric linear actuator from foreign matters when the telescopic electric linear actuator moves. A rotating mechanism including the motor and the reducer may drive the single supporting arm cylinder to rotate, and thus drive the rotating plate structure of the single supporting arm unit to rotate. The rotational speed of the motor can be reduced by the reducer so as to increase a torque, and the reducer may employ a harmonic reducer. An electric linear actuator is arranged in the middle of the single supporting arm cylinder, which may push the baffle to displace in an axial direction of the single supporting arm unit. Two ends of the single supporting arm unit each is provided with a connecting flange for connecting another single supporting arm unit or the telescopic electric linear actuator unit.

In the single supporting arm unit, the electric linear actuator drives the baffle to displace to make the rotating plate structure be switched between a rotation state and a motion state, where the rotation state and the motion state respectively correspond to opened and closed states of the comb teeth or sieve pores when different functions are performed. In the rotation state, the gaps between the comb teeth and the sieve pores are opened to allow the mud to pass through, thus reducing the resistance born by the single supporting arm unit in the process of rotating. In the motion state, the gaps between the comb teeth and the sieve pores are closed to increase the resistance, thus preventing the single supporting arm unit from displacing in the mud.

The comb-shaped rotating plate structure is provided as an example for analyzing the action mode: in the rotation state, the electric linear actuator contracts and pulls the toothed baffle to achieve the effect of "one-to-two", such that the toothed spacing of the rotating plate structure is exposed to reduce the effective area of the rotating plate structure; and then, the rotating plate structure is driven by the motors of the single supporting arm unit to rotate around an axis, and at the moment, the mud may pass through the gaps between the teeth to prevent the rotation of the rotating plate structure from being hindered. In the motion state, the electric linear actuator extends and pushes the toothed baffle to move to shield the toothed spacing of the rotating plate structure, and at this moment, the toothed baffle and the rotating plate structure achieve the effect of "two in one". When the telescopic electric linear actuator unit drives the robot to move, the single supporting arm unit may play a good role in positioning in the mud.

During the use, the single supporting arm unit is respectively in two different spatial states, namely, a vertical state and a horizontal state, due to its different relative position relationship with space. In the vertical state, a plane where the longest diagonal of the rotating plate structure is located is perpendicular to a traveling direction of the robot, and at the moment, due to the increase of the effective blocking area, the single supporting arm unit is subjected to the greatest resistance in the traveling direction, and can be better positioned and supported by means of the mud. In the horizontal state, a plane where the longest diagonal of the rotating plate structure is located is parallel to the traveling direction of the robot, and at the moment, the single supporting arm unit is subjected to the least resistance in the traveling direction, and can move forward better in the sediments.

The following describes the state change involved during the operation of the robot in detail.

Figure 6A:
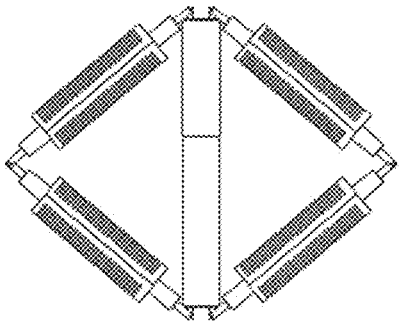
FIG. 6A and FIG. 6B are effect diagrams of a robot in a fully expanded state and a fully contracted state.
Figure 6B:
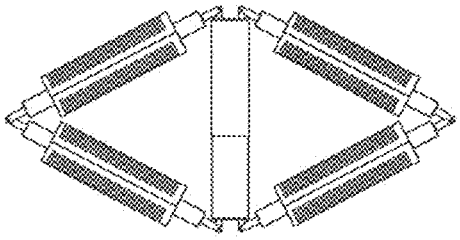

When the telescopic linear actuator unit is extended to the longest state under the action force of the electric linear actuator, the robot is in a fully expanded state, as shown in FIG. 6A. When the telescopic linear actuator unit is contracted to the shortest state under the action force of the electric linear actuator, the robot is in a fully contracted state, as shown in FIG. 6B.

Figure 7A:
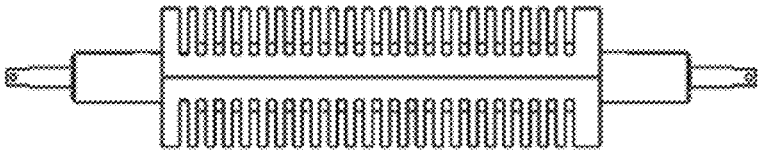
FIG. 7A and FIG. 7B are effect diagrams of the single supporting arm unit of the robot in a rotation state and a motion state.
Figure 7B:
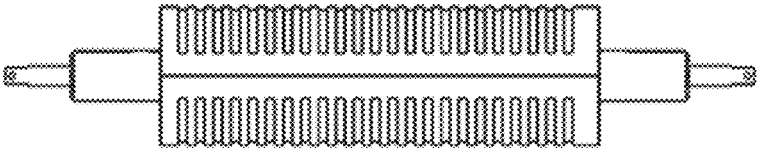

The single supporting arm unit has two different attitude states which are defined as a rotation state (as shown in FIG. 7A) and a motion state (as shown in FIG. 7B). When different functions are performed, the states are switched by pushing of the baffle driven by the electric linear actuator 12, and the single supporting arm unit may be adjusted to the corresponding attitude to meet the operation requirements. Due to its small effective area, the rotation state facilitates the rotation action of the single supporting arm unit. Due to its large effective area, the motion state may avoid the hindering of the mud when the single supporting arm unit is in traveling, and may increase the resistance during the position of the single supporting arm unit.

Figure 8A:
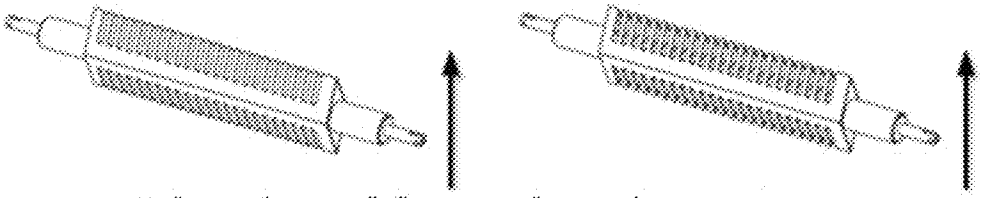
FIG. 8A, FIG. 8B, FIG. 8C and FIG. 8D are schematic diagrams showing a switching process between a horizontal state and a vertical state of a drilling rig and a single supporting arm of the robot.
Figure 8B:
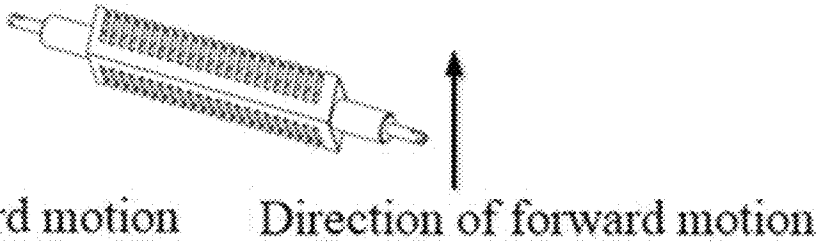
Figure 8C:
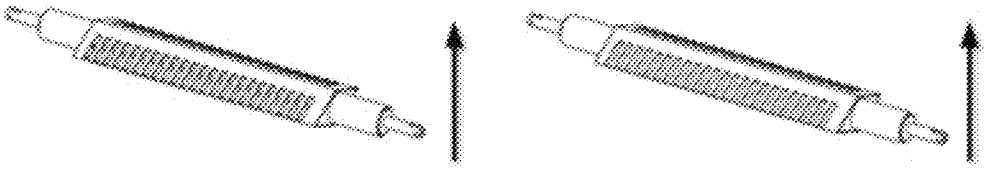
Figure 8D:
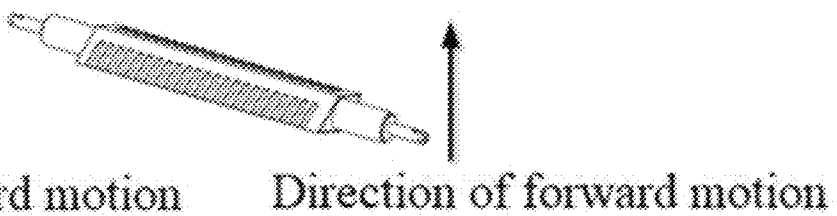

The single supporting arm unit has two different spatial states, which are defined as a horizontal state (as shown in FIG. 8A and FIG. 8B) and a vertical state (as shown in FIG. 8C and FIG. 8D), when the relative position relationship with space is different. The single supporting arm unit in the vertical state may better achieve supporting in the mud or soil, and the single supporting arm unit in the horizontal state may better achieve forward motion in the mud or soil.

In the operation process of the robot, the switching of the two spatial states, namely, the vertical state and the horizontal state, may combine the switching of the two attitude states, namely, the rotation state and the motion state, of the single supporting arm unit. Therefore, with the combined acting force of the single supporting arm unit and the telescopic electric linear actuator unit, the robot may achieve forward propulsion and turning actions.

The linkage switching mode of the spatial state and attitude state of the single supporting arm unit is described as follows.

(1) At the moment shown in FIG. 8A, the spatial state of the single supporting arm unit is horizontal, and the attitude state is the motion state. Such states are applicable to blocking positioning rather than performing action of rotating in place.

(2) At the moment shown in FIG. 8B, in order to reduce the resistance encountered in rotation, the baffle is moved under the action of the electric linear actuator to expose the gaps between the teeth, the single supporting arm unit is switched from the motion state to the rotation state, and at the moment, the single supporting arm unit may perform the rotating action.

(3) At the moment shown in FIG. 8C, the single supporting arm unit has completed the rotation, the spatial state is switched to the vertical state, but the attitude state is still in the rotation state.

(4) At the moment shown in FIG. 8D, the single supporting arm unit may perform the forward motion, and the attitude state needs to be changed in order to reduce the obstruction of the mud or soil. The baffle is pushed under the action of the electric linear actuator to shield the gaps between the teeth, and the single supporting arm unit is switched from the rotation state to the motion state.

Figure 9A:
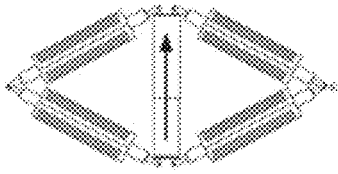
FIG. 9A, FIG. 9B, FIG. 9C, FIG. 9D, FIG. 9E and FIG. 9F are schematic diagrams showing forward motion of single supporting arm units of the robot.

When the robot moves forwards:

(1) At the moment shown in FIG. 9A, it is an initial state when the robot moves forwards.

Figure 9B:
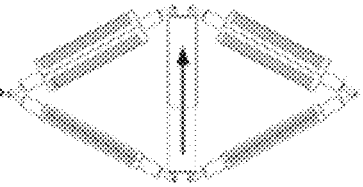

(2) At the moment shown in FIG. 9B, when the robot is ready for forward motion, the single supporting arm units at the left rear part and the right rear part are switched to the vertical state to play a supporting role; and the single supporting arm units at the left front part and the rear front part are still in the horizontal state to play a role in moving forward.

Figure 9C:
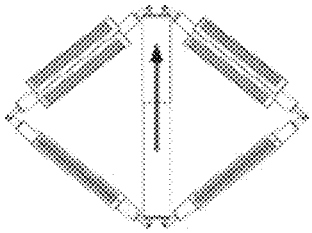

(3) At the moment shown in FIG. 9C, with the combined action of the telescopic electric linear actuator unit, the single supporting arm units at the left front part and the right front part, the robot moves forwards, and when the robot reaches a fully expanded state, this forward motion is completed.

Figure 9D:
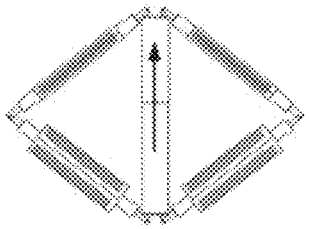

(4) At the moment shown in FIG. 9D, when the robot is ready for contraction and recovery, the single supporting arm units at the left front part and right front part of the robot are switched to the vertical state to play a supporting role; the single supporting arm units at the left rear part and the right rear part are switched to the horizontal state to play a forward motion role.

Figure 9E:
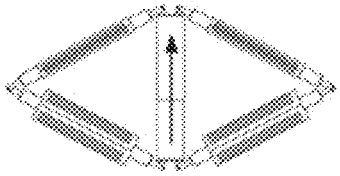

(5) At the moment shown in FIG. 9E, under the combined action of the telescopic electric linear actuator unit, the single supporting arm units at the left rear part and the right rear part, the robot performs contraction motion, and when the robot reaches the fully contracted state, this contraction operation is completed.

Figure 9F:
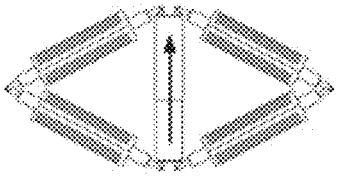

(6) At the moment shown in FIG. 9F, after completing a round of extension and contraction operation, various body units of the robot are restored to their original states. A long-distance forward-motion operation can be achieved by repeating the operations (1) to (5).

Figure 10A:
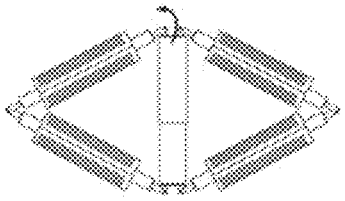
FIG. 10A, FIG. 10B, FIG. 10C, FIG. 10D, FIG. 10E and FIG. 10F are schematic diagrams showing left steering motion of the single supporting arm units of the robot.

When the robot is steering (take left steering as an example, and right steering is the same):

(1) At the moment as shown in FIG. 10A, it is an initial state of the robot during a steering motion.

Figure 10B:
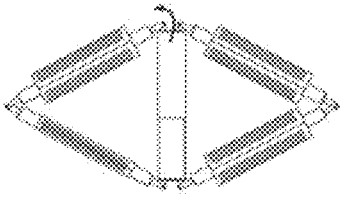

(2) At the moment as shown in FIG. 10B, when the robot is ready for a left steering motion, the single supporting arm unit at the left rear part is switched to the vertical state to play a supporting role, and the single supporting arm units at the left front part, the right front part and the right rear part are still in the horizontal state to play a forward motion role.

Figure 10C:
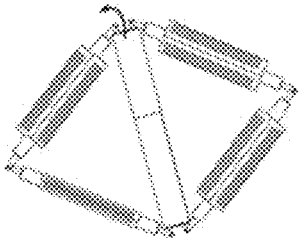

(3) At the moment as shown in FIG. 10C, under the combined action of the telescopic electric linear actuator unit, the single supporting arm units at the left front part, the right front part and the right rear part, the robot performs left steering motion, and when the robot reaches a fully expanded state, this left steering operation is completed.

Figure 10D:
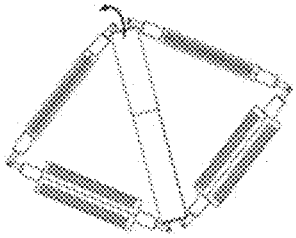

(4) At the moment as shown in FIG. 10D, when the robot is ready for contraction and recovery, the single supporting arm unit at the left front part of the robot is switched to the horizontal state to play a forward motion role; the single supporting arm units at the left rear part, the right rear part and the right front part are switched to the vertical state to play a supporting role.

Figure 10E:
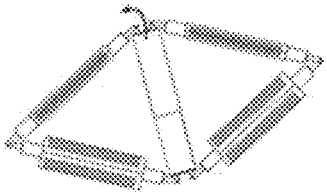

(5) At the moment as shown in FIG. 10E, under the combined action of the telescopic electric linear actuator unit, the single supporting arm units at the left front part and the right front part, the robot is contracted, and when the robot reaches a fully contracted state, this contraction operation is completed.

Figure 10F:
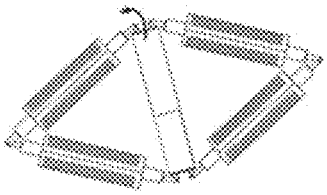

(6) At the moment shown in FIG. 10F, after completing a round of extension and contraction operation, various body units of the robot are restored to their original states. The steering operation with a greater angle can be achieved by repeating the operations (1) to (5).

The following will introduce the specific application method of the submarine stratum space cable laying robot.

1. The energy supply control cable on a ship is connected to the connecting terminal at the tail end of the robot for supplying power to the motor of the robot and transmitting a control signal; and a cable to be laid is fixed to the latched mechanism at the tail end of the robot.

2. An additional releaser on the ship is used to press the whole robot into the submarine stratum.

3. The controller on the ship is used to control the robot to perform the operations of moving forward and steering.

Finally, it should be noted that the examples listed above are merely specific embodiments of the present disclosure. Apparently, the present disclosure is not limited to the above embodiments and may have many variations. All variations that would be directly derived from or associated with the contents disclosed in the present disclosure by those of ordinary skill in the art should fall within the scope of protection of the present disclosure.

What is claimed is:

1. A submarine stratum space cable laying robot, comprising a main body structure of the robot serving as a traction tool, wherein a tail end of the main body structure is provided with a connecting terminal for connecting an energy supply control cable, and a latched mechanism for hanging a cable to be laid, wherein the main body structure of the robot comprises:

one telescopic electric linear actuator unit, comprising two dustproof sleeves with one sleeved on another to form a closed internal cavity together, wherein a driving motor and telescopic electric linear actuators are arranged in the closed internal cavity to enable the two dustproof sleeves to displace relative to each other along an axial direction; and connectors are respectively arranged at two closed ends of the dustproof sleeves; and four single supporting arm units having a same structure and being for forward motion and supporting, each comprising a hollow single supporting arm cylinder;

wherein two ends of each single supporting arm unit are symmetrically and sequentially provided with rotating supporting plates, reducers, motors and connecting flanges from inside to outside respectively;

wherein an outside of the hollow single supporting arm cylinder is provided with a rotating plate structure, and the rotating plate structure is provided with a rotating plate component symmetrically arranged along an axis;

wherein the four single supporting arm units are divided into two groups, and wherein two single supporting arm units in each group are movably connected by connecting flanges at adjacent ends of the two single supporting arm units and are movably connected to the connectors of the telescopic electric linear actuator unit by connecting flanges on respective outer ends of the two single supporting arm units;

wherein the two groups of single supporting arm units are connected in series and symmetrically arranged with the telescopic electric linear actuator unit such that the main body structure of the robot is diamond-shaped.

2. The submarine stratum space cable laying robot according to claim 1, wherein the rotating plate component is comb-shaped and sieve-shaped, and is fitted with a baffle; wherein the baffle is a toothed baffle or a sieve baffle which can be driven by a driving component to displace so as to shield gaps between teeth or shield sieve pores.

3. The submarine stratum space cable laying robot according to claim 2, wherein the driving component is an electric linear actuator arranged in a cavity of the hollow single supporting arm cylinder, the baffle connected to the electric linear actuator and displaced in an axial direction under driving of the electric linear actuator to shield the gaps between the teeth or the sieve pores of the rotating plate component; wherein the baffle has a structure and a shape adaptive to the rotating plate component and covers the rotating plate component, or wherein an axial groove is formed in a middle of the rotating plate component, and the baffle is arranged in the axial groove.

4. The submarine stratum space cable laying robot according to claim 1, wherein in a direction perpendicular to a symmetry axis, cross-sectional shapes of the rotating plate structure and the baffle are roughly diamond-shaped.

5. The submarine stratum space cable laying robot according to claim 1, wherein:

the rotating plate structure comprises two rotating plate components which are symmetrically arranged in an axial direction, a center of each rotating plate component provided with a semi-circular groove for installing the single supporting arm cylinder; and wherein:

two ends of each of the rotating plate component and the single supporting arm cylinder are fixed to the rotating supporting plates respectively; or an axial center of the rotating plate structure is provided with a tubular cavity, the single supporting arm cylinder is sleeved in the rotating plate structure, and both ends of the rotating plate structure or the single supporting arm cylinder are fixed to the rotating supporting plates; or the rotating plate structure and the single supporting arm cylinder are of an integrated structure, two ends of which are fixed to the rotating supporting plates.

6. The submarine stratum space cable laying robot according to claim 1, wherein the rotating supporting plates are fixedly connected to the reducers, the reducers being connected to output ends of the motors, and the motors fixedly connected to the connecting flanges.

7. The submarine stratum space cable laying robot according to claim 1, wherein two ends of each of the telescopic electric linear actuators are connected to outer ends of the dustproof sleeves respectively.

8. The submarine stratum space cable laying robot according to claim 1, wherein the two dustproof sleeves are in clearance fit, and are sealed with an O-shaped sealing ring.

9. The submarine stratum space cable laying robot according to claim 1, wherein two connectors are arranged at each of outer ends of the dustproof sleeves, and the connecting flanges at outer ends of each group of single supporting arm units are respectively connected to corresponding connectors.

10. The submarine stratum space cable laying robot according to claim 1, wherein the connectors and the connecting flanges are provided with through holes, the connectors and the connecting flanges being connected by passing pins into the through holes.

* * * * *